US007261141B2

(12) United States Patent
Nakajima

(10) Patent No.: US 7,261,141 B2
(45) Date of Patent: Aug. 28, 2007

(54) METAL POROUS BODY MANUFACTURING METHOD

(76) Inventor: Hideo Nakajima, 6-40, Goban-cho, Hiyoshidai, Takatsuki-shi, Osaka 569-1022 (JP)

( * ) Notice: Subject to any disclaimer, the term of this patent is extended or adjusted under 35 U.S.C. 154(b) by 0 days.

(21) Appl. No.: 10/504,832

(22) PCT Filed: Aug. 26, 2002

(86) PCT No.: PCT/JP02/08560

§ 371 (c)(1),
(2), (4) Date: Aug. 17, 2004

(87) PCT Pub. No.: WO03/070401

PCT Pub. Date: Aug. 28, 2003

(65) Prior Publication Data

US 2005/0145364 A1 Jul. 7, 2005

(30) Foreign Application Priority Data

Feb. 22, 2002 (JP) ..... 2002-045941

(51) Int. Cl.
*B22D 27/04* (2006.01)
*B22D 27/13* (2006.01)

(52) U.S. Cl. ..... 164/66.1; 164/79; 164/122

(58) Field of Classification Search ..... 164/79, 164/66.1, 122, 122.1
See application file for complete search history.

(56) References Cited

U.S. PATENT DOCUMENTS

| | | | | |
|---|---|---|---|---|
| 5,181,549 A * | 1/1993 | Shapovalov | ..... | 164/79 |
| 6,250,362 B1 * | 6/2001 | Rioja et al. | ..... | 164/46 |
| 7,073,558 B1 * | 7/2006 | Nakajima | ..... | 164/66.1 |

FOREIGN PATENT DOCUMENTS

| | | | |
|---|---|---|---|
| EP | 1 231 287 A1 | | 8/2002 |
| JP | 59-202138 | * | 11/1984 |
| JP | 04-123861 | | 4/1992 |
| JP | 5-59462 | * | 3/1993 |
| JP | 2000-239760 | * | 9/2000 |
| WO | WO98/11264 | | 3/1998 |
| WO | WO 01/04367 A1 | | 1/2001 |

OTHER PUBLICATIONS

Supplementary European Search Report from corresponding European Application No. EP 02 76 0741.

* cited by examiner

*Primary Examiner*—Kevin P. Kerns
(74) *Attorney, Agent, or Firm*—Knobbe, Martens, Olson & Bear, LLP

(57) ABSTRACT

A process for producing a porous metal body, the process includes melting part of a starting metal material in succession while moving the material by a floating zone melting method under a gas atmosphere to dissolve a gas into a resultant molten metal; and solidifying the molten metal zone in succession by cooling. Even when the starting metal material is of low thermal conductivity, a porous metal body with uniform and micro pores grown only in the longitudinal direction is produced.

13 Claims, 9 Drawing Sheets

SUS304L (moving rate=160 μm/s)

METAL POROUS BODY MANUFACTURING METHOD

This application is the U.S. National Phase under 35 U.S.C. §371 of International Application PCT/JP02/08560, filed on Aug. 26, 2002, which claims priority of Japanese Patent Application No. 2002-45941, filed on Feb. 22, 2002. The International Application was published under PCT Article 21(2) in a language other than English.

TECHNICAL FIELD

The present invention relates to a process for the production of a porous metal body.

BACKGROUND OF THE INVENTION

In recent years, porous material bodies such as porous metals have been intensively studied, and are in progress in the development toward practical use as filters, hydrostatic bearings, medical instruments, sporting goods and the like.

U.S. Pat. No. 5,181,549, for example, describes a process for the production of a porous body such as a porous metal. More specifically, the production process comprises dissolving hydrogen or a hydrogen-containing gas under pressure into a molten metal material, and then cooling the molten metal to solidify the same under the controlled temperature and pressure conditions.

Japanese Unexamined Patent Publication No. 10-88254 discloses a process for producing a porous metal which comprises the steps of melting a metal under a pressurized gas atmosphere and solidifying the molten metal, the metal having a eutectic point in the metal-gas phase diagram under an isobaric gas atmosphere. Japanese Unexamined Patent Publication No. 2000-104130 discloses a process for producing a porous metal body having pores controlled in shape etc., which process comprises the steps of dissolving hydrogen, oxygen, nitrogen or the like into a molten metal under a pressurized atmosphere, and cooling the molten metal to solidify it while controlling the temperature and pressure.

According to the above-described processes, a metal melted in a crucible is poured into a mold and solidified through heat dissipation from the mold. When a metal having a high thermal conductivity such as copper, magnesium or the like is employed in these processes, the molten metal is rapidly solidified through heat dissipation, so that comparatively uniform pores can be formed. However, when these processes are applied to the cases where commonly-used materials for practical use such as steels, stainless steels, etc. are used, cooling rates decrease in the inner part of metal body due to the low thermal conductivity thereof, which results in a significant formation of coarse pores, and thus it is difficult to form uniform pores. Such a porous body with uneven pore sizes is disadvantageous in that high strengths cannot be ensured because greater stresses are exerted around larger pores when a load is applied. Moreover, such a porous body cannot be used as a filter which needs uniformity of pore diameter.

DISCLOSURE OF THE INVENTION

The present invention has been developed in view of the aforementioned problems of the prior art. The present invention chiefly aims to provide a novel process for the production of a porous metal body, by which uniform pores can be formed regardless of the thermal conductivity of the starting material used, and furthermore, a number of uniform pores elongated in one direction can be formed even when producing a long or a large-seized products in the shape of a rod, a plate or the like.

The inventors have conducted intensive research to achieve the above objectives. The inventors found that the following outstanding effectiveness is achieved by a specific process using a floating zone melting method which comprises the steps of partially melting the starting metal material while moving the material; dissolving various types of gases into the molten metal; and solidifying the molten metal. That is, according to the process, the amount of a gas which dissolves into a molten metal can be controlled by suitably determining the kind of gas to be used, the combination of gases, gas pressure, etc. and further pore shape, pore size, porosity, etc. can be arbitrarily controlled by selecting the moving rate of a starting metal material, the cooling method, etc. Moreover, the inventors found that the process can produce a porous body with micro pores elongated in one direction even when using a long or large-sized starting metal material of low thermal conductivity. The present invention has been completed based on these novel findings.

The present invention provides a process for the production of a porous metal body and a porous metal body produced by the production process, as described below:

1. A process for producing a porous metal body, the process comprising: melting part of a starting metal material in succession while moving the material by a floating zone melting method under a gas atmosphere to dissolve a gas into a resultant molten metal zone; and solidifying the molten metal zone in succession by cooling.

2. The process described above under item 1, wherein the starting metal material is melted under an atmosphere containing a gas to be dissolved, the gas being at least one selected from the group consisting of hydrogen, nitrogen, oxygen, fluorine and chlorine.

3. The process described above under item 2, wherein the pressure of the gas to be dissolved is in the range of $10^{-3}$ Pa to 100 MPa.

4. The process described above under item 1, wherein the starting metal material is melted under a mixed gas atmosphere of a gas to be dissolved and an inert gas.

5. The process described above under item 4, wherein the pressure of the inert gas is in the range of 0 to 90 MPa.

6. The process described above under item 1, wherein the starting metal material is iron, nickel, copper, aluminum, magnesium, cobalt, tungsten, manganese, chromium, beryllium, titanium, silver, gold, platinum, palladium, zirconium, hafnium, molybdenum, tin, lead, uranium, or alloys comprising one or more of these metals.

7. The process described above under item 1, wherein the melting temperature of the starting metal material is within a range from its melting point to 500° C. higher than the melting point.

8. The process described above under item 1, wherein the moving rate of the starting metal material is within a range of 10 μm/second to 10,000 μm/second.

9. The process described above under item 1, wherein the starting metal material is moved while being rotated at a rotation rate of 1 to 100 rpm.

10. The process described above under item 1, wherein either natural-cooling or forced-cooling is applied for solidifying the molten metal by cooling.

11. The process described above under item 10, wherein the molten metal is subjected to forced-cooling by one or more methods selected from a cooling method through gas-blowing, a cooling method through contact with a water-cooling jacket, and a cooling method through contact with a cooling block at one or both ends of the starting metal material.

12. The process described above under item 1, wherein the starting metal material is held under reduced pressure at a temperature ranging from room temperature to a temperature below the melting point of the metal, thereby degassing the starting metal material, prior to the starting metal material being melted by a floating zone melting method.

13. A porous metal body obtained by any of the processes described above under item 1 through item 12.

14. The porous metal body described above under item 13, wherein an iron-based metal is used as the starting metal material, and nitrogen is used as the gas to be dissolved.

Figure 1:
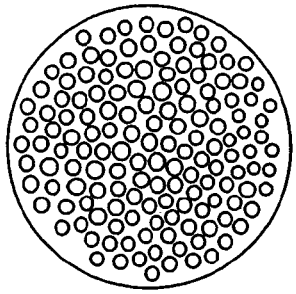
FIG. 1 is a cross sectional view schematically illustrating a porous metal body obtained by the present invention.

In the drawings, reference numeral 1 denotes an airtight container, reference numerals 2 and 3 denote sealing elements, reference numeral 4 denotes an exhausting tube, reference numeral 5 denotes a gas supply tube, reference numeral 6 denotes a starting metal material, reference numeral 7 denotes a high-frequency heating coil, reference numeral 8 denotes a blower, reference numerals 9A and 9B denote blowing pipes, reference numeral 10 denotes a cooling unit, reference numerals 11 and 12 denote cooling-water circulation pipes, reference numeral 13 denotes a cooling jacket and reference numerals 14 and 15 denote cooling-water circulation pipes.

SPECIFIC EMBODIMENTS OF THE PRESENT INVENTION

In the present invention, usable as a starting metal material is a material that has a high degree of gas solubility in liquid phase and has a low degree of gas solubility in solid phase. Such a metal in a molten state dissolves a large quantity of gas. However, the amount of dissolved gas sharply decreases when the metal begins to solidify with a decrease in the temperature. Therefore, the temperature and ambient gas pressure are properly controlled when the starting metal material is melted, and the molten metal is solidified while adequately selecting the cooling rate, the ambient gas pressure, etc., whereby bubbles can be formed in solid phase near the interface between solid phase and liquid phase due to the separation of gas which has been dissolved in liquid phase. These gas bubbles arise and grow with the solidification of the metal, whereby numerous pores are formed in solid phase portion.

According to the process of the present invention, as described below in detail, the starting metal material is partially melted successively by a floating zone melting method, and gas is dissolved into the molten metal. Thereafter, the molten metal is solidified while controlling the cooling conditions, whereby the pore shape, pore diameter, porosity and the like in the resulting product can be suitably controlled. Consequently, a porous metal body can be formed which has a number of micro pores elongated in one direction.

Figure 2:
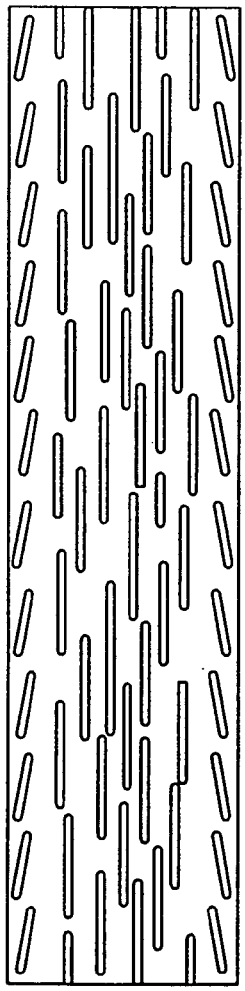
FIG. 2 is a longitudinal sectional view schematically illustrating a porous metal body obtained by the present invention.

FIG. 1 is a cross sectional view schematically illustrating the porous metal body obtained by the process of the present invention. FIG. 2 is a longitudinal sectional view schematically illustrating the porous metal body. As can be seen from FIGS. 1 and 2, the process of the present invention provides the porous metal body in which a number of approximately uniform micro pores extended in the longitudinal direction is formed.

According to the process of the invention, any material can be used as a starting metal material without limitation insofar as the material has a high degree of gas solubility in liquid phase and has a low degree of gas solubility in solid phase. More specifically, the process of the invention enables the use of metal materials of low thermal conductivity as starting metal materials, such as steels, stainless steels, nickel-based super alloys and so on, which were difficult to give uniform pores by known methods. Usable as the starting metal materials are iron, nickel, copper, aluminum, magnesium, cobalt, tungsten, manganese, chromium, beryllium, titanium, silver, gold, platinum, palladium, zirconium, hafnium, molybdenum, tin, lead, uranium, etc. and alloys comprising one or more of these metals.

Figure 3:
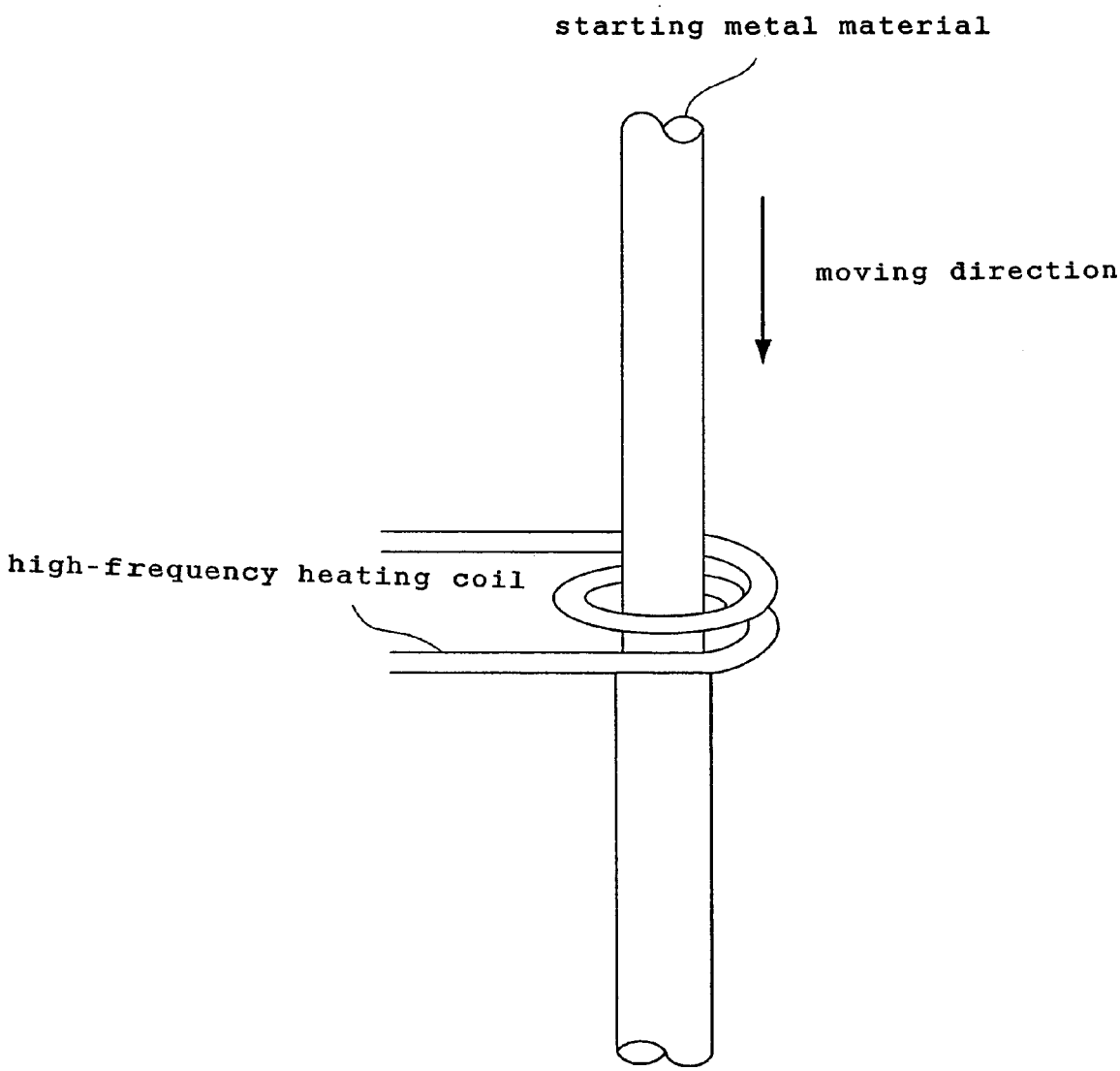
FIG. 3 is a view schematically showing a process for successively melting part of a starting metal material while the material is moved vertically.

According to the process of the present invention, the starting metal material is partly melted in succession while being moved by a floating zone melting method. The moving direction of the starting metal material is not particularly limited, and may be set to any direction such as a direction perpendicular to gravity, a direction parallel to gravity, etc. FIG. 3 schematically illustrates a production process for vertically moving a rod-shaped starting metal material while melting part of the material continuously.

The starting metal materials are not particularly limited in the shape, and may be in any shape insofar as the starting metal material can be partially melted and solidified by cooling in succession by the floating zone melting method. For example, a long starting metal material in the shape of a rod, a plate, a cylindrical tube or the like can be used. When the metal material is in the shape of a rod, it is preferably cylindrical and 0.3 to 200 mm in diameter, for enabling the material to cool rapidly to the inside thereof when cooled. In the case of a plate-shaped starting metal material, the plate-shaped long metal is preferably about 0.1 to 100 mm thick and about 0.1 to 500 mm wide.

The conditions in the floating zone melting method are not particularly limited, and can be suitably selected as in the known methods.

For partly heating the metal material, a heating method employed in the art of floating zone melting method can be suitably adopted. Usually, a high frequency induction heating is employed. However, other heating methods can be used, such as laser heating, resistance heating through Joule heat, heating with an electrical resistance heating furnace, infrared heating, arc heating, etc.

The amount of dissolved gas increases with a rise in the temperature of the molten portion, whereas the high temperature of the molten portion requires a prolonged cooling time for the molten metal to be solidified and thus the pore diameter tends to be large. A suitable melting temperature may be determined by taking into consideration the aforementioned factors. Generally, it is preferable that the melting temperature is within the range from melting point to about 500° C. higher than the melting point.

The length of the portion to be melted may be determined depending on the kind and the shape of the starting metal material used and the like, and may be within the range in which the shape of the molten portion can be maintained due to surface tension without falling of the molten portion.

If necessary, the starting metal material may be rotated at a rate of about 1 to 100 rpm. When the starting metal material is moved while rotating, the starting metal material is uniformly heated during melting. In particular, a rod-shaped starting metal material with a large diameter is caused to rotate on the longitudinal axis, so that the material can be heated more uniformly, which permits quick and uniform melting.

According to the process of the present invention, the molten portion should be placed in an atmosphere containing a gas to be dissolved (i.e., dissolving gas). When the starting metal material is melted under the dissolving gas atmosphere, a large amount of gas can dissolve in the molten portion of the starting metal material.

For the dissolving gas, depending on the type of the starting metal material used, usable is a gas which has a high degree of solubility in a liquid phase metal and has a low degree of solubility in a solid phase metal. Examples of such gases are hydrogen, nitrogen, oxygen, fluorine, chlorine, etc. These gases can be used alone or in combinations of two or more. In view of safety, hydrogen, nitrogen, oxygen and the like are preferred among these gases. In some cases, the pores formed contain only the dissolving gas. In other cases, the pores formed may contain gases produced by a reaction of component in the molten metal with the dissolved gas. For example, when oxygen is used as the dissolving gas and carbon is contained in the molten metal material, the pores formed may contain carbon monoxide, carbon dioxide, etc.

When the starting metal material is iron, nickel or alloys containing these metals, it is preferable to use at least one gas selected from the group consisting of hydrogen and nitrogen as the dissolving gas. When the starting metal material is copper, aluminum, magnesium, cobalt, tungsten, manganese, chromium, beryllium, titanium, palladium, zirconium, hafnium, molybdenum, tin, lead, uranium or alloys containing these metals, hydrogen is preferred as the dissolving gas. When the starting metal material is silver, gold or alloys containing these metals, oxygen is preferred as the dissolving gas.

The dissolving gas has a tendency to be increasingly dissolved in the molten metal with an increase of the gas pressure, which leads to a higher porosity of the resultant porous metal body. Accordingly, the dissolving gas pressure may be appropriately determined by taking into consideration the type of starting metal material, the desired pore shape, pore diameter and porosity of the resultant porous body, and the like. The dissolving gas pressure is preferably about $10^{-3}$ Pa to 100 MPa, and more preferably 10 Pa to 10 MPa.

In the floating zone melting method according to the invention, the molten portion and the cooled/solidified portion are usually maintained in the same gas atmosphere. The pore diameter and porosity of the porous metal body can be more accurately controlled when the dissolving gas is admixed with an inert gas.

More specifically, when a mixture of the dissolving gas and an inert gas is used and the inert gas pressure is kept constant, the porosity of the porous body increases with an increase in the dissolving gas pressure. On the contrary, when the dissolving gas pressure is kept constant, the porosity of the porous body decreases with an increase in the inert gas pressure. These phenomena may be attributed to the following fact. That is, the inert gas hardly dissolves into the molten metal. Thus, in the case of applying a high inert gas pressure, when the molten metal is being cooled to be solidified, the porous body is pressurized by inert gas because of low solubility thereof into the molten metal. Consequently, the pore volume of the porous body reduces.

Meanwhile, the porosity in the porous body tends to increase with an increase in the total gas pressure of the gas mixture.

Usable inert gases include helium, argon, neon, krypton, xenon, etc. These gases can be used singly or in a combination of two or more gases.

The inert gas pressure is not limited, but may be appropriately determined so that the desired porous body is formed. It is preferably about 90 MPa or less. The mixing ratio of the dissolving gas and the inert gas is not particularly limited, but generally, the inert gas pressure is about 95% or less of the total pressure of the dissolving gas and the inert gas. In order to attain effects with use of an inert gas-added mixture, the inert gas pressure may be generally about 5% or more of the total pressure.

Figure 4:
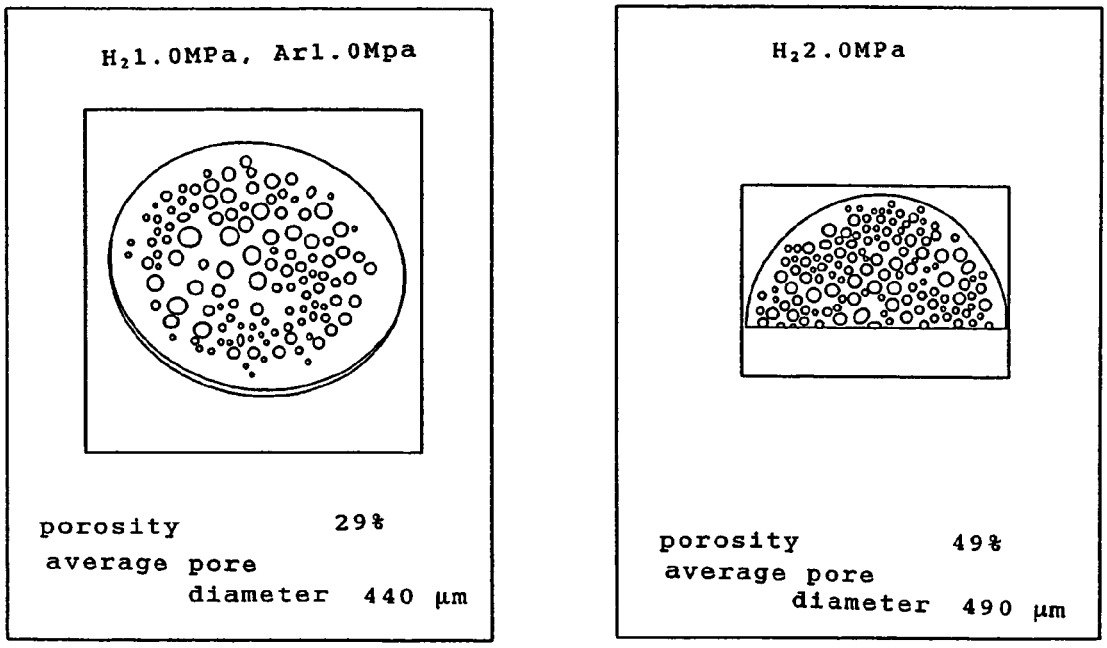
FIG. 4 shows cross sectional views schematically illustrating porous stainless steel bodies obtained by the present invention: one view illustrating a porous stainless steel body produced under a mixed gas atmosphere of hydrogen and argon, and the other view illustrating a porous stainless steel body produced under a hydrogen atmosphere.

FIG. 4 schematically shows cross sections of porous stainless steel bodies (SUS304L): one being produced under a mixed gas atmosphere containing 1.0 MPa of hydrogen and 1.0 MPa of argon and the other being produced under a hydrogen gas atmosphere containing 2.0 MPa of hydrogen. The porous bodies shown in FIG. 4 are produced at a moving rate of 160 μm/second for the starting metal material and at a melting temperature of 1430 to 1450° C. The cross section of the porous body produced under 2.0 MPa of hydrogen is only partially illustrated.

FIG. 4 indicates that when a mixed gas containing hydrogen (1.0 MPa) and argon (1.0 MPa) is used, the porosity is very low, and the pore diameter is also small.

Figure 5:
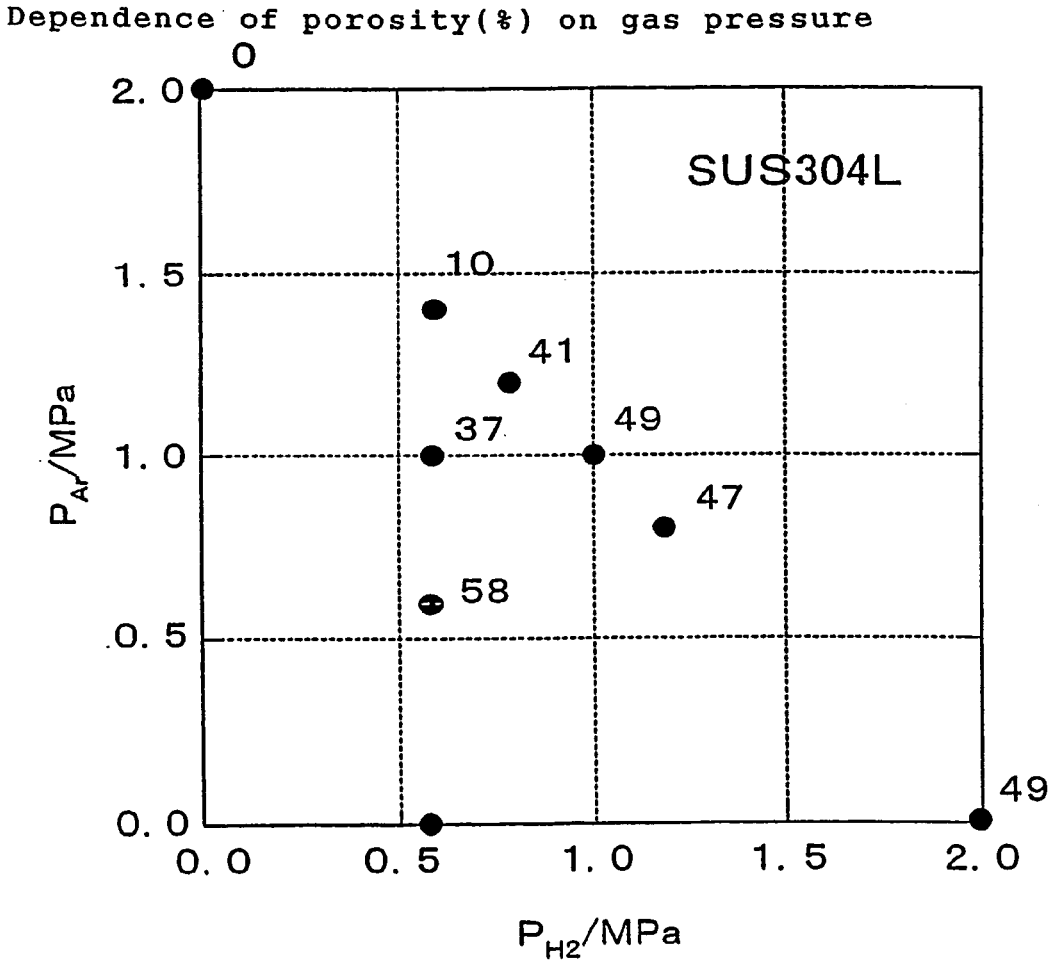
FIG. 5 is a graph showing the relationship between porosity and hydrogen partial pressure/argon partial pressure in the case where a porous stainless body is produced under a mixed gas atmosphere of hydrogen and argon.

FIG. 5 is a graph showing the relationship between hydrogen/argon partial pressure and porosity in a porous body which is produced using a stainless steel (SUS304L) as the starting metal material under a mixed gas atmosphere of hydrogen and argon. This graph shows that when the argon partial pressure increases with the hydrogen pressure maintained, for example, at 0.6 Mpa, the bubble volume, i.e., porosity decreases. Moreover, when the total gas pressure is held constant, the porosity increases with an increase in the hydrogen partial pressure.

By melting the starting metal material and then cooling the molten metal for solidification as clarified above, a number of pores are formed in solid phase near solid phase/liquid phase interface due to the separation of gas which has been dissolved into the metal in the liquid state. According to the process of the present invention employing the floating zone melting method, the metal material is continuously cooled while the metal material is moved. Thus, the cooling rate is approximately constant in the longitudinal direction of the metal. Therefore, the pore shape, pore diameter, porosity and the like can be controlled in the longitudinal direction, whereby a porous body with uniform pores extended in the longitudinal direction can be obtained.

In this case, the pore diameter of the porous body can be controlled by varying the moving rate of the starting metal material. More specifically, a higher cooling rate achieved by a higher moving rate of the starting metal material prevents bubbles from actively uniting to become coarse. Thus, a porous body with pores of small diameter can be obtained.

The moving rate of the starting metal material is not particularly limited, and may be determined by taking into consideration the size of the starting metal material used, the desired pore diameter and the like so that a suitable cooling rate is attained. Generally, the moving rate is within the range of about 10 μm/second to 10,000 μm/second.

Furthermore, when the molten metal portion is subjected to forced-cooling for solidification, the whole of metal can be more rapidly cooled as compared to when subjected to natural-cooling. Thus, enlargement of pores inside the metal body is suppressed and formation of pores of smaller diameter is ensured. In particular, even when using a metal of low thermal conductivity, forced-cooling at a suitably determined cooling rate allows a rapid cooling to the inside of the metal body, whereby uniform pores can be formed.

Figure 6:
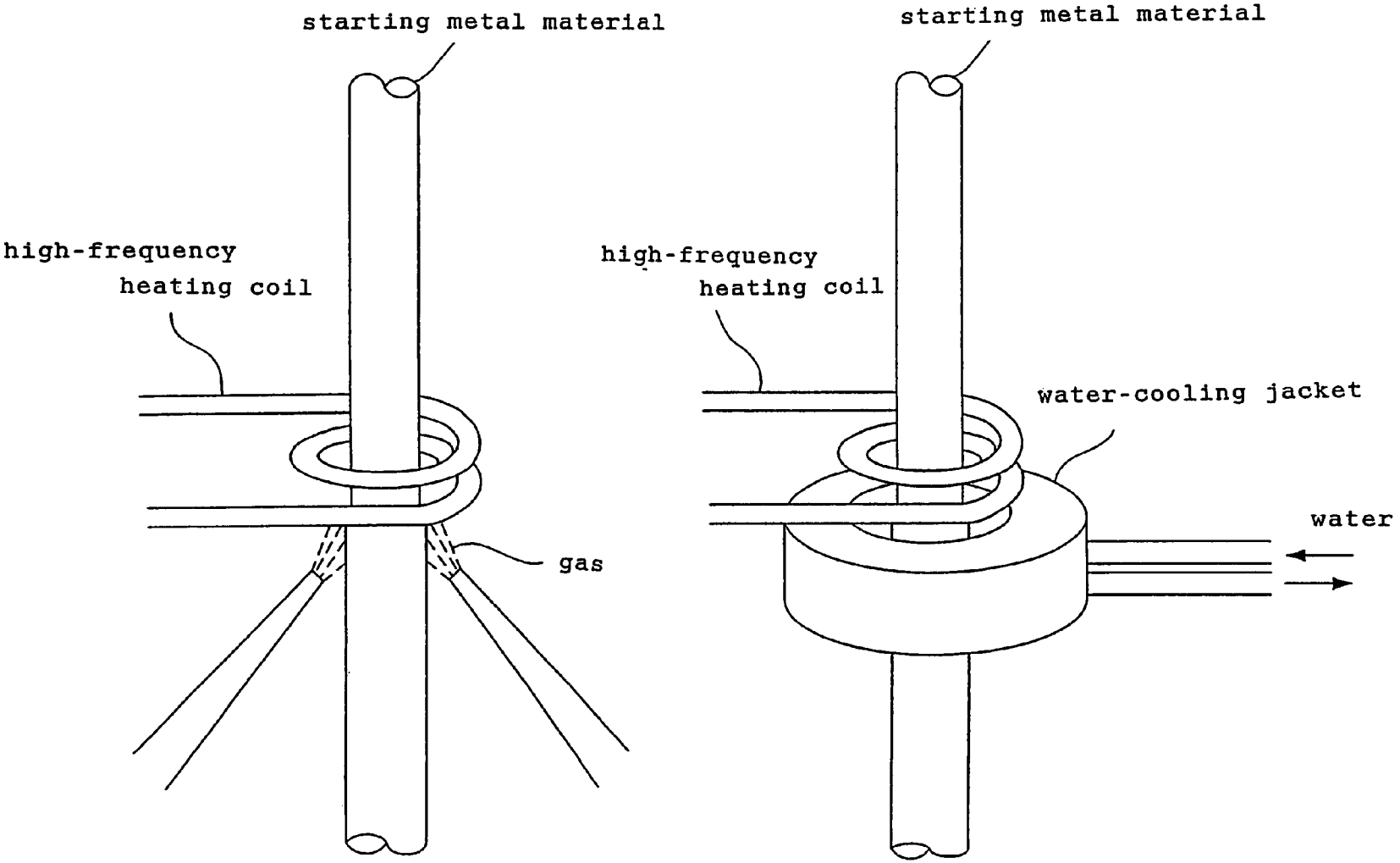
FIG. 6 shows views schematically illustrating two modes for performing forced-cooling of the molten metal according to the floating zone melting method.

The forced-cooling method is not particularly limited, and various methods can be adopted, including cooling through gas-blowing; cooling through contact with a cooling jacket in which the inner surface is formed corresponding to the outer shape of the starting metal material; and cooling through contact with a water-cooling block at one or both ends of the starting metal material. In FIG. 6, the left view schematically shows a cooling method by gas-blowing, and the right view schematically shows a cooling method using a water-cooling jacket. The gas-blowing method includes, for example, a method for blowing gas under pressure to a portion to be solidified while circulating an ambient gas of low temperature which has been retained at the bottom of the apparatus.

When such a method is employed to carry out the forced-cooling, a large temperature gradient is maintained independently of the moving rate of the metal body. Thus, the cooling rate increases with an increase in moving rate, whereby a porous body with pores of smaller diameter can be obtained.

Figure 7:
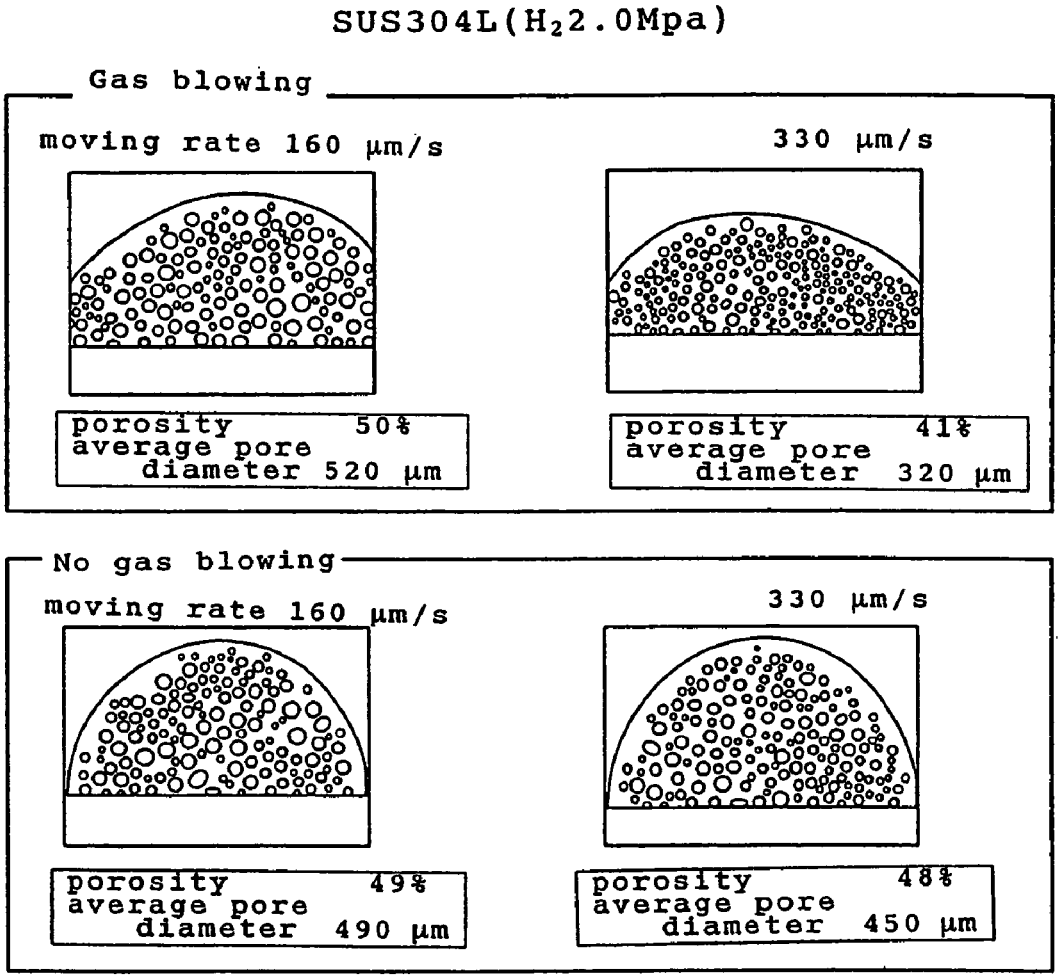
FIG. 7 schematically shows cross sectional views partly illustrating porous metal bodies obtained under varied moving rate of starting metal material: each of two views illustrating a porous metal body subjected to gas-blowing when cooling to solidify the molten metal; and each of the other two views illustrating a porous metal body not subjected to gas-blowing.

FIG. 7 is a cross sectional view partially illustrating porous metal bodies, which were produced at 160 μm/second and at 330 μm/second in the moving rate of the starting metal material, respectively: one being subjected to forced-cooling through gas-blowing and the other being not. These porous materials were produced using stainless steel (SUS304L) as the starting metal material under an atmosphere of 2.0 MPa of hydrogen at a melting temperature of 1,430 to 1,450° C.

As can be seen from FIG. 7, a rise in the moving rate of the starting metal material creates a tendency that the pore diameter decreases and porosity is lowered. In particular, the gas-blowing method strongly reinforces this tendency.

Moreover, according to the process of the present invention, the starting metal material may be degassed, if necessary, before the starting metal material is melted by the floating zone melting method. The degassing process may be conducted by placing the starting metal material for the porous body in an airtight container, and holding the same under reduced pressure at a temperature within the range of room temperature to a temperature lower than the melting point of the metal. This process reduces the amount of impurities contained in the metal, and thus a porous metal body of higher quality can be obtained.

The reduced pressure condition in the degassing step varies depending on the type of starting metal material used, the impurity components to be removed (such as oxygen, nitrogen and hydrogen) from the starting metal material and the like. The pressure is usually about 7 Pa or lower, and preferably in the range of about 7 Pa to $7\times10^{-4}$ Pa. If the pressure reduction is insufficient, the remaining impurities may impair the corrosion resistance, mechanical strength, toughness and so forth of the porous metal body. In contrast, excessive pressure reduction improves the performance of the resulting porous metal body to a certain extent, but greatly increases the costs of producing and operating the apparatus, and hence undesirable.

The temperature at which the starting metal material is maintained during degassing is between room temperature and a temperature lower than the melting point of the starting metal material, and preferably a temperature of about 50° C. lower than the melting point to 200° C. lower than the melting point.

The holding time of the metal during the degassing step may be suitably determined depending on the type and amount of impurities contained in the metal, the extent of degassing required and the like.

Figure 8:
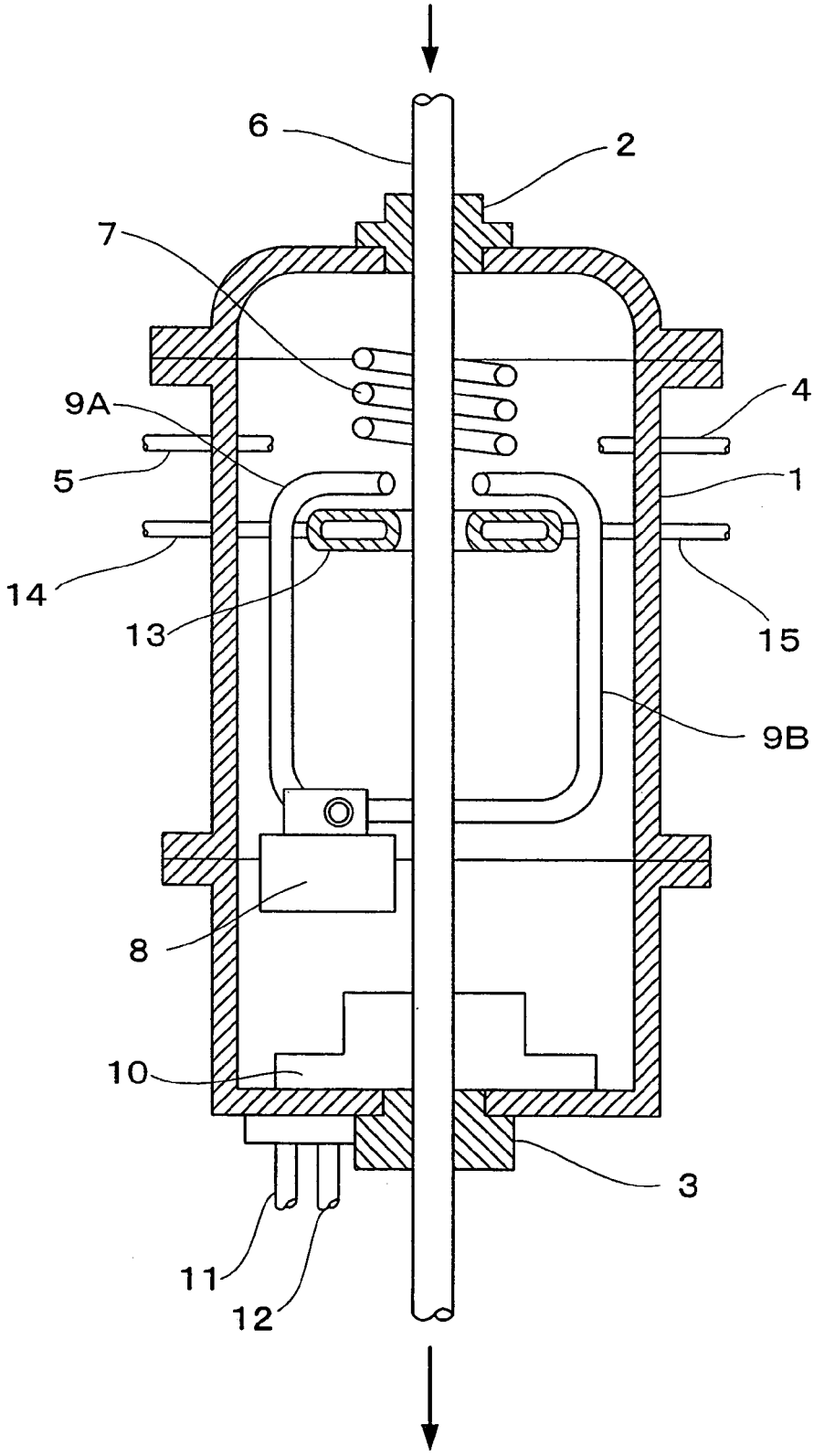
FIG. 8 is a sectional view schematically showing an example of an apparatus for producing a porous metal body used in the present invention.

FIG. 8 is a sectional view illustrating an example of an apparatus for use in producing a porous metal body according to the process of the invention.

A porous metal body is produced using the apparatus in FIG. 8 as described below. Initially, a vacuum pump (not shown) is driven to evacuate the airtight container 1 via an exhausting tube 4. The dissolving gas and inert gas are then introduced thereinto through a gas supply tube 5 until the pressure within the airtight container 1 is elevated to a predetermined gas pressure. The airtight container 1 is hermetically closed by means of sealings 2 and 3 or the like.

The type and pressure of the gas to be introduced into the airtight container 1 may be suitably determined according to the desired porosity and the like, which is estimable, for example, on the basis of the relationship between the porosity and gas pressure preliminary established as shown in FIG. 5.

A starting metal material 6 is introduced into the airtight container 1 at a predetermined moving rate using a moving mechanism (not shown) attached to the production apparatus, and is then heated by a heating means, such as a high-frequency heating coil 7, to be partially melted continuously. The dissolving gas in the ambient atmosphere is dissolved into the molten metal portion.

The starting metal material 6 moving downward at the predetermined rate and having passed a heating area where the high-frequency heating coil 7 or the like is provided, is then cooled to change from the molten state into a solidified state.

The apparatus illustrated in FIG. 8 is provided with the following three types of cooling mechanisms for cooling the starting metal material 6 having passed the heating portion: a mechanism in which the gas in the container is circulated by a blower 8 provided within the airtight container 1 and blown onto the starting metal material from blowing pipes 9A and 9B; another mechanism for cooling the end portion of the starting metal material by circulating cooling-water through cooling-water circulation pipes 11 and 12 using a cooling unit 10 provided at the bottom of the airtight container 1; and another mechanism for contact cooling by circulating cooling-water through the cooling-water circulation pipes 14 and 15 using a ring-shaped cooling jacket 13 positioned around the starting metal material. In the apparatus shown in FIG. 8, depending on the desired pore shape, pore diameter, porosity and the like, at least one of these cooling mechanisms can be adopted, or instead, natural-cooling can be used.

In the solidified metal, bubbles are formed due to separation of dissolved gas from the molten metal. These gas bubbles are extended in the longitudinal direction as the metal solidifies, thereby producing a porous metal body with a number of pores.

The porous metal body produced is taken out from the apparatus through sealing 3. This completes the production process.

As described above, the process of the present invention provides a porous metal body in which uniform and micro pores are extended in the longitudinal direction. According to the process of the present invention, the pore shape, porosity and the like can be controlled as desired even when materials of low thermal conductivity such as steels, stainless steel, nickel-based superalloy, etc. are used. Therefore, the process of the present invention is of great utility.

Pore shape, pore diameter, porosity and the like in the porous metal material produced can be controlled as desired by suitably determining the melting temperature, the type and pressure of the dissolving gas used, the mixing ratio of inert gas, the moving rate of the starting metal material, the cooling conditions and the like. Generally, pore diameters can be controlled within the broad range of about 10 μm to 10 mm. Furthermore, a porous body with micro pores of about 10 μm or less in pore diameter can be produced. Moreover, the porosity can be selectable as desired within a broad range of about 80% or less.

According to the process of the present invention, when iron-based metals such as industrial-grade pure iron, carbon steel, stainless steel, Fe—Cr alloy, cast iron, etc. are used as the starting metal material, and nitrogen is used as the dissolving gas, the porous metal body produced is endowed with extremely high tensile strength, compressive strength and the like. Such a porous body is of great utility as a weight-reduced and high-strength metal material. Moreover, the production process is highly useful since a high level of safety in production can be achieved due to nitrogen serving as the dissolving gas.

The reason why such a high strength porous iron-based material is obtained by using nitrogen as the dissolving gas is considered as follows. That is, according to the process of the present invention, the dissolved nitrogen forms a solid solution with an iron-containing metal. Consequently, the resultant porous metal is strengthened due to the formation of such a solid solution and the dispersion of nitride in the porous material, in addition to the formation of uniform and micro pores.

INDUSTRIAL APPLICABILITY

According to the process for the production of a porous metal body of the invention, the pore shape, pore diameter, porosity and the like can be readily controlled. Further, even when a starting metal material of low thermal conductivity is used, a porous metal body with uniform and micro pores extended in the longitudinal direction can be obtained.

The porous metal body produced is light-weight and has high specific strength (strength/weight), excellent machinability, weldability and so forth. Porous metal bodies according to the present invention can be utilized in a wide range of fields because of such unique structure and excellent characteristics.

In particular, a porous body of iron-based alloy produced under a nitrogen atmosphere is of high utility as a light-weight and high-strength iron material.

Examples of applications for the porous body produced according to the present invention are hydrogen storage materials, vibration-proof materials, shock absorbing materials, electromagnetic shielding materials, parts and structural members in various structures (main structural materials, engine parts and other parts for transportation means such as automobiles, ships, airplanes and so forth, ceramics supports for rocket engines or jet engines, light-weight panels for space equipment, machine tool parts, etc.), materials for medical appliances (such as artificial joints, artificial teeth, etc.), heat exchange materials, heat sink materials, sound insulation materials, gas/liquid separation materials, light-weight structural parts, self-lubricating bearing materials, hydrostatic bearings, filters, gas-blowing materials in gas/liquid reactions, and so forth. The porous metal body produced according to the present invention is not limited to the above applications, and can be utilized in various other applications as well.

BEST MODE FOR CARRYING OUT THE PRESENT INVENTION

The present invention will be described in more detail with reference to Examples.

EXAMPLE 1

Various types of porous metal bodies varying in porosity were produced using iron of 99.99% purity as a starting metal material and employing the apparatus shown in FIG. 8. As the starting metal material, a cylindrical material 10 mm in diameter and 1,000 mm long was used.

Nitrogen or hydrogen was supplied into the apparatus as the dissolving gas, and argon was further supplied so as to control the porosity, where necessary.

The moving rate of the starting metal material was set at 160 μm/second. A high-frequency heating coil was used as the heating means, and the temperature of the melting portion was maintained at 1,555° C.

Figure 9:
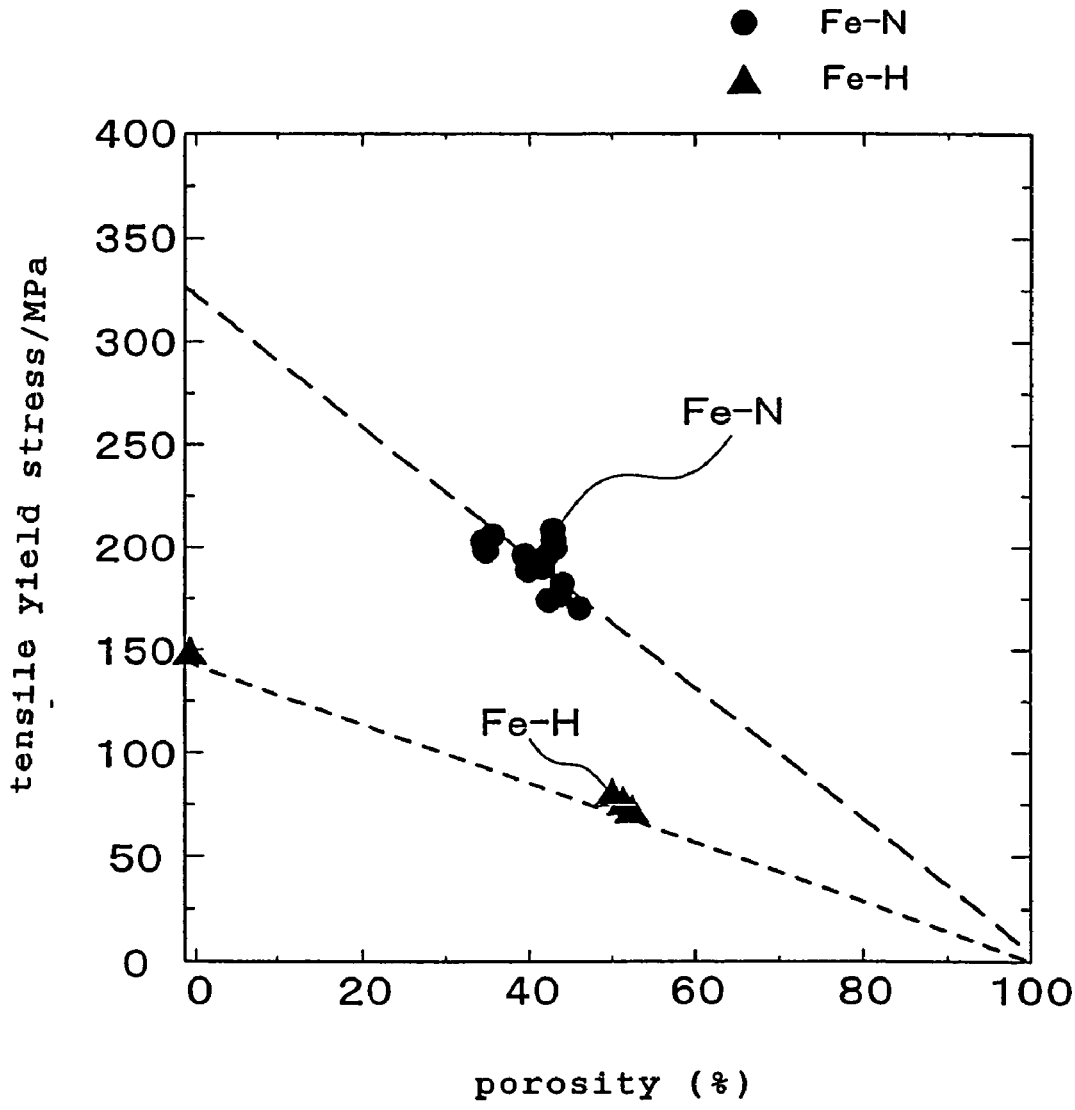
FIG. 9 is a graph showing the relationship between porosity and the tensile yield stress in a direction parallel to the growth direction of pores for a porous iron body obtained using nitrogen or hydrogen as a gas to be dissolved.
Figure 10:
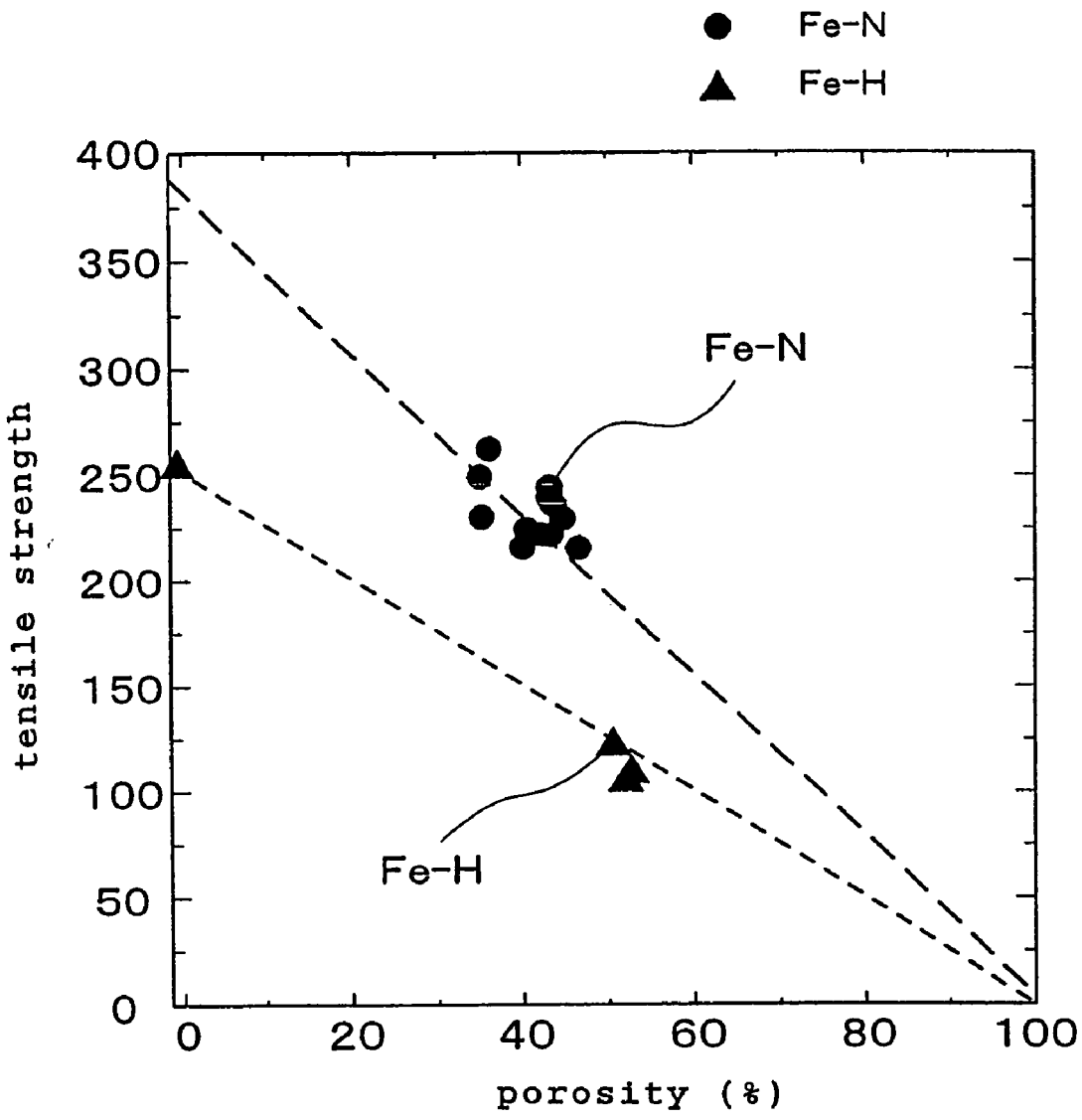
FIG. 10 is a graph showing the relationship between porosity and the tensile strength in a direction parallel to a growth direction of pores for a porous iron body obtained using nitrogen or hydrogen as the gas to be dissolved.

FIG. 9 is a graph showing the relationship between the porosity and the tensile yield stress of the porous metal material obtained. FIG. 10 is a graph showing the relationship between the porosity and the tensile strength. The graph in FIG. 9 shows measurement results on tensile yield stresses in a direction parallel to a growth direction of pores.

The graph in FIG. 10 shows measurement results on tensile strength in a direction parallel to a growth direction of pores.

Table 1 below shows the relationship between the pressure of the dissolving gas/inert gas and average porosity with reference to some materials of the porous metal materials as illustrated in FIGS. 9 and 10.

TABLE 1

| Pressure conditions (MPa) | | | Average porosity |
|---|---|---|---|
| $N_2$ pressure | $H_2$ pressure | Ar pressure | (%) |
| 1.0 | — | 1.5 | 35.1 |
| 2.0 | — | 0.5 | 40.5 |
| 2.5 | — | 0 | 42.8 |
| 2.0 | — | 0 | 44.2 |
| — | 2.0 | 0.5 | 52.0 |
| — | 2.5 | 0 | 48.2 |

As can be seen from FIGS. 9 and 10, when a porous metal body is produced using iron as the starting metal material under a nitrogen atmosphere, a high-strength porous body is obtained as compared with the porous metal body produced under a hydrogen atmosphere.

In more detail, a porous metal body produced under a nitrogen atmosphere exhibits substantially the same tensile strength as an iron material with no pores, even when the porous material body has a 40% porosity. Thus, such a porous metal body is highly useful as a weight-reduced and high-strength iron material.

The invention claimed is:

1. A process for producing a porous metal body, the process comprising:

moving a first portion of a starting metal material through a heating area thereby melting said first portion without melting the entire starting material to produce a molten metal zone in the first portion of said starting material, wherein the heating area is under a gas atmosphere to dissolve a gas into the molten metal zone in the first portion;

continuing to move the first portion out of the heating area and a second portion of the starting material is moved through the heating area;

solidifying the molten metal zone in the first portion by cooling;

melting said second portion without melting the entire starting material to produce a molten metal zone in the second portion of said starting material, wherein the heating area is under a gas atmosphere to dissolve a gas into the molten metal zone in the second portion;

continuing to move the second portion out of the heating area; and solidifying the molten metal zone in the second portion by cooling.

2. The process according to claim 1, wherein the starting metal material is melted under an atmosphere containing a gas to be dissolved, the gas being at least one selected from the group consisting of hydrogen, nitrogen, oxygen, fluorine and chlorine.

3. The process according to claim 2, wherein the pressure of the gas to be dissolved is in the range of $10^{-3}$ Pa to 100 MPa.

4. The process according to claim 1, wherein the starting metal material is melted under a mixed gas atmosphere of a gas to be dissolved and an inert gas.

5. The process according to claim 4, wherein the pressure of the inert gas is in the range of 0 to 90 MPa.

6. The process according to claim 1, wherein the starting metal material is iron, nickel, copper, aluminum, magnesium, cobalt, tungsten, manganese, chromium, beryllium, titanium, silver, gold, platinum, palladium, zirconium, hafnium, molybdenum, tin, lead, uranium, or alloys comprising one or more of these metals.

7. The process according to claim 1, wherein the melting temperature of the starting metal material is within a range from its melting point to 500° C. higher than the melting point.

8. The process according to claim 1, wherein the starting material is moved with a moving rate within a range of 10 μm/second to 10,000 μm/second.

9. The process according to claim 1, wherein the starting metal material is moved while being rotated at a rotation rate of 1 to 100 rpm.

10. The process according to claim 1, wherein either natural-cooling or forced-cooling is applied for solidifying the molten metal by cooling.

11. The process according to claim 10, wherein the molten metal is subjected to forced-cooling by one or more methods selected from a cooling method through gas-blowing, a cooling method through contact with a cooling jacket, and a cooling method through contact with a water-cooling block at one or both ends of the starting metal material.

12. The process according to claim 1, wherein the starting metal material is held under reduced pressure at a temperature ranging from room temperature to a temperature below the melting point of the metal, thereby degassing the starting metal material, prior to the starting metal material being melted by moving through the heating area.

13. The process according to claim 1, wherein an iron-based metal is used as the starting metal material, and nitrogen is used as the gas to be dissolved.

* * * * *